US010092468B2

(12) United States Patent
Hashimoto

(10) Patent No.: US 10,092,468 B2
(45) Date of Patent: Oct. 9, 2018

(54) NURSING BED AND SHAPE CHANGE METHOD THEREOF

(71) Applicant: KAWASAKI JUKOGYO KABUSHIKI KAISHA, Kobe-shi, Hyogo (JP)

(72) Inventor: Yasuhiko Hashimoto, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 96 days.

(21) Appl. No.: 14/654,764

(22) PCT Filed: Dec. 24, 2013

(86) PCT No.: PCT/JP2013/084451
§ 371 (c)(1),
(2) Date: Jun. 22, 2015

(87) PCT Pub. No.: WO2014/098247
PCT Pub. Date: Jun. 26, 2014

(65) Prior Publication Data

US 2015/0335505 A1 Nov. 26, 2015

(30) Foreign Application Priority Data

Dec. 21, 2012 (JP) ..... 2012-279510

(51) Int. Cl.
*A61G 7/018* (2006.01)
*A61G 7/015* (2006.01)
(Continued)

(52) U.S. Cl.
CPC ..... *A61G 7/018* (2013.01); *A47C 20/04* (2013.01); *A61G 7/002* (2013.01); *A61G 7/015* (2013.01); *A61G 7/0573* (2013.01)

(58) Field of Classification Search
CPC ..... A61G 7/002; A61G 7/015; A61G 7/018; A61G 7/057; A61G 7/05723; A61G 7/0573; A47C 20/04; A47C 20/041
See application file for complete search history.

(56) References Cited

U.S. PATENT DOCUMENTS 1,276,526 A * 8/1918 Hardy ..... A61H 1/008 601/103
2,773,498 A * 12/1956 Himmelman ..... 5/934
(Continued)

FOREIGN PATENT DOCUMENTS

JP H01-238859 A 9/1989
JP H07-8523 A 1/1995
(Continued)

OTHER PUBLICATIONS

Jun. 23, 2015 International Preliminary Report on Patentability issued in International Patent Application No. PCT/JP2013/084451.
(Continued)

*Primary Examiner* — Nicholas F Polito
*Assistant Examiner* — David R Hare
(74) *Attorney, Agent, or Firm* — Oliff PLC

(57) ABSTRACT

To provide a nursing bed capable of preventing bedsores of a care receiver while minimizing a burden on the body of the care receiver when changing posture. A nursing bed with a longitudinal dimension and a width dimension has an upper surface forming member which forms a bed upper surface on which a care receiver lies and a driving mechanism configured to move at least a portion of the upper surface forming member. The bed upper surface includes a curved surface which is curved downwardly in the width direction.

11 Claims, 11 Drawing Sheets

(51) Int. Cl.

| | |
|---|---|
| ***A61G 7/002*** | (2006.01) |
| ***A47C 20/04*** | (2006.01) |
| ***A61G 7/057*** | (2006.01) |

(56) References Cited

U.S. PATENT DOCUMENTS

| | | | | | |
|---|---|---|---|---|---|
| 3,200,416 | A * | 8/1965 | Warrick | A61G 7/002 | 5/608 |
| 3,298,363 | A * | 1/1967 | Parkin | 5/236.1 | |
| 3,717,376 | A * | 2/1973 | Lutchansky | A47C 31/123 | 297/284.1 |
| 3,970,077 | A * | 7/1976 | Dahl | A61G 7/0573 | 601/115 |
| 4,799,276 | A * | 1/1989 | Kadish | A61G 7/0573 | 137/901 |
| 5,092,315 | A * | 3/1992 | Bennett | A61H 1/00 | 601/101 |
| 5,109,558 | A * | 5/1992 | Di Blasi | A61G 7/0573 | 5/236.1 |
| 5,233,712 | A * | 8/1993 | Jurus | A61G 7/0573 | 5/611 |
| 5,626,555 | A * | 5/1997 | Di Blasi | A47C 21/006 | 5/612 |
| 5,842,237 | A * | 12/1998 | Hargest | A61G 7/002 | 4/446 |
| 6,651,281 | B1 * | 11/2003 | Figiel | A61G 7/052 | 5/607 |
| 6,799,342 | B1 * | 10/2004 | Jarmon | A61G 7/0573 | 5/191 |
| 7,552,491 | B2 * | 6/2009 | Voelker | A61G 7/0573 | 5/241 |
| 7,905,846 | B2 * | 3/2011 | Ganti | A61H 23/006 | 601/101 |
| 8,011,044 | B1 * | 9/2011 | Jones | A61G 5/10 | 297/284.3 |
| 8,424,134 | B2 * | 4/2013 | Byun | A61G 7/0005 | 5/236.1 |
| 2006/0021142 | A1 * | 2/2006 | Hornbach | A47C 19/045 | 5/600 |
| 2007/0074343 | A1 * | 4/2007 | McNulty | A61G 1/003 | 5/81.1 HS |

FOREIGN PATENT DOCUMENTS

| | | | |
|---|---|---|---|
| JP | H07-303674 | A | 11/1995 |
| JP | 2716093 | B2 | 2/1998 |
| JP | H11-239524 | A | 9/1999 |
| JP | 2000-325408 | A | 11/2000 |
| JP | 2000-342633 | A | 12/2000 |
| JP | 2002-078755 | A | 3/2002 |
| JP | 2002-085481 | A | 3/2002 |
| JP | 2004-222908 | A | 8/2004 |
| JP | 4231363 | B2 | 2/2009 |

OTHER PUBLICATIONS

Jan. 28, 2014 International Search Report issued in International Patent Application No. PCT/JP2013/084451.

* cited by examiner

NURSING BED AND SHAPE CHANGE METHOD THEREOF

TECHNICAL FIELD

The present invention relates to a nursing bed and a shape change method thereof, and particularly relates to a nursing bed provided with a function for preventing a bedsore and a shape chage method thereof.

BACKGROUND ART

Care receivers get bedsores easily if they need to be in bed for a long time, which is severely painful for them. Bedsores occur especially in parts of a body such as a waist, shoulders, and ankles which protrude with bones when blood circulation becomes poor there by pressure of the body weight, resulting in necrosis.

Posture of a care receiver need to be changed appropriately in order to prevent bedsores, and in particular when the care receiver has difficulty moving his/her body by himself/herself, appropriate countermeasures such as putting a pillow under the waist of the care receiver need to be taken by a caregiver.

The caregiver needs to work for preventing bedsores by moving a heavy body of the care receiver, which is a hard labor. Moreover, the work needs to be done night and day, for example every one or two hours, which is a heavy burden for the caregiver. Also, the care receiver tends to feel a mental burden about forcing a hard labor on the caregiver.

In order to reduce such a burden on the caregiver (and the care receiver), a technique of making a portion of a bed upper surface (sleeping surface) of a nursing bed movable so as to change posture of the care receiver by appropriately moving the movable portion of the bed upper surface manually or using power (refer to Patent Documents 1 to 7 below).

RELATED ART DOCUMENTS

Patent Documents

[Patent Document 1] Japanese Patent Application Laid-open No. H01-238859

[Patent Document 2] Japanese Patent Application Laid-open No. H07-8523

[Patent Document 3] Japanese Patent Application Laid-open No. H07-303674

[Patent Document 4] Japanese Patent Application Laid-open No. H11-239524

[Patent Document 5] Japanese Patent Application Laid-open No. 2000-325408

[Patent Document 6] Japanese Patent Application Laid-open No. 2002-85481

[Patent Document 7] Japanese Patent Application Laid-open No. 2004-222908

SUMMARY OF INVENTION

Problems to be Solved by the Invention

However, as a conventionally proposed nursing bed has a flat upper surface (sleeping surface), even if a part thereof is risen for example, it has been difficult to realize a natural motion similar to a turning movement of a care receiver in bed. Thus, unnatural strong force is locally applied to the care receiver, resulting in a burden on the body of the care receiver.

Note that, a nursing bed disclosed in Patent Document 5 is configured to pull up one ends of a plurality of belt-shaped members laid under the body of a care receiver when changing the posture of the care receiver so as to make the care receiver roll onto on his/her side slightly.

However, in such a configuration that the belt-shaped member is hoisted, the belt-shaped member pressures the care receiver on the bottom part of the hoisting belt, resulting in strong force applied locally. Thus, the problem that an excessive burden is applied on the body of the care receiver has not been solved.

The present invention is made considering the above-mentioned problems and its object is to provide a nursing bed capable of preventing bedsores of a care receiver while minimizing a burden on the body of the care receiver when changing posture, and a shape change method thereof.

In order to achieve the above-mentioned object, the present invention provides a nursing bed with a dimension in the longitudinal direction and a dimension in the width direction, comprising an upper surface forming member which forms a bed upper surface on which a care receiver lies; and a driving mechanism configured to move at least a portion of the upper surface forming member, the bed upper surface including a curved surface which is curved downwardly in the width direction.

Also, it is preferable that the driving mechanism is configured to move the at least a portion of the upper surface forming member along the curved surface.

Also, it is preferable that the curved surface is an arc surface which configures a portion of a virtual cylinder surface with a center axis line extending along the longitudinal direction.

Also, it is preferable that the driving mechanism is configured to move the at least a portion of the upper surface forming member in the horizontal direction.

Also, it is preferable that the at least a portion of the upper surface forming member is configured by juxtaposing in the longitudinal direction a plurality of movable strips extending in the width direction.

Also, it is preferable that the driving mechanism has a unit configured to move at least a portion of the plurality of movable strips in the vertical direction and a unit configured to move the at least a portion of the plurality of movable strips which has been moved upwardly along the curved surface or in the horizontal direction.

Also, it is preferable that the plurality of movable strips are classified into at least two groups and configured to move a plurality of movable strips belonging to each of the at least two groups simultaneously by the driving mechanism.

Also, it is preferable that each of the at least two groups is configured by at least a portion of the plurality of movable strips which are arranged alternately in the longitudinal direction.

Also, it is preferable that the at least a portion of the upper surface forming member configures a center portion in the longitudinal direction of the upper surface forming member.

Also, it is preferable that a part of the upper surface forming member on a leg side of the care receiver in the longitudinal direction is configured by a plurality of movable rectangular pieces which are divided in both directions of the longitudinal direction and the width direction, and the nursing bed being provided with an additional driving mechanism configured to move at least a portion of the plurality of movable rectangular pieces so as to raise a portion of the bed upper surface.

Also, it is preferable that the driving mechanism is configured so that a rotational driving force is transmitted from a rotational driver mounted on a distal end portion of a robot arm.

Also, it is preferable that the driving mechanism has a plurality of rotated drivers which are selectively and separatably connected to the rotational driver where the plurality of rotated drivers are respectively installed corresponding to mutually different moving motions in the upper surface forming member.

In order to achieve the above-mentioned object, the present invention provides a shape change method of a nursing bed, wherein the nursing bed comprises an upper surface forming member which forms a bed upper surface on which a care receiver lies and also are divided into a plurality of portions, and a driving mechanism configured to move at least a portion of the plurality of portions of the upper surface forming member, the driving mechanism moving at least a portion of the plurality of portions of the upper surface forming member in a predetermined order so as to change a shape of the bed upper surface.

In order to achieve the above-mentioned object, the present invention provides a shape change method of a nursing bed wherein the nursing bed comprises an upper surface forming member which forms a bed upper surface on which a care receiver lies and a driving mechanism configured to move at least a portion of the upper surface forming member, the driving mechanism being configured so that a rotational driving force is transmitted from a rotational driver mounted on a distal end portion of a robot arm and having a plurality of rotated drivers which are selectively and separatably connected to the rotational driver, the plurality of rotated drivers being respectively installed corresponding to mutually different moving motions in the upper surface forming member, the rotational driver driving the plurality of rotated drivers in a predetermined order.

Advantageous Effect of the Invention

A nursing bed and a shape change method thereof according to the present invention can realize a natural motion similar to a turning movement in bed so as to minimize a burden on the body of a care receiver when changing posture, preventing bedsores.

EMBODIMENT OF THE INVENTION

Hereunder, the nursing bed having a power transmission device according to an embodiment of the present invention and the shape change method thereof are described with reference to the drawings.

Figure 1:
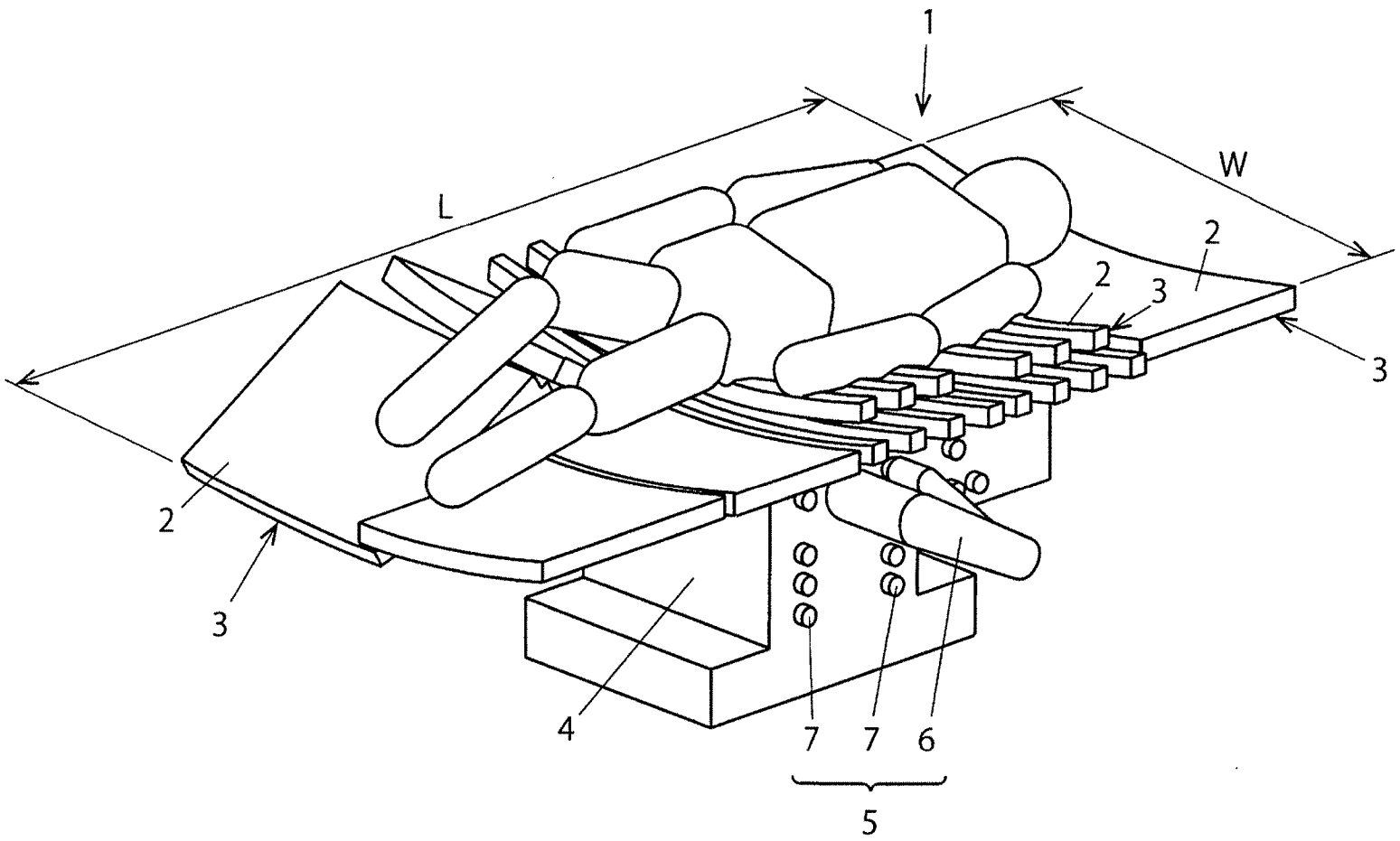
FIG. 1 is a perspective view illustrating a nursing bed with a power transmission device according to an embodiment of the present invention.

As illustrated in FIG. 1, a nursing bed 1 of the embodiment has a dimension L in the longitudinal direction and a dimension W in the width direction. The longitudinal dimension L and the width dimension W correspond to the longitudinal dimension and the width dimension of an upper surface forming member 3 which forms a bed upper surface 2 on which a care receiver lies.

The upper surface forming member 3 is arranged on a bed base 4 to which a driving mechanism 5 for moving at least a portion of the upper surface forming member 3 in the horizontal direction is provided.

Additionally, in the nursing bed 1 of the embodiment, the bed upper surface 2 is configured as a whole by a curved surface which is curved downwardly in the width direction W. The curved surface is an arc surface which configures a part of a virtual cylinder surface with the center axis line extending along the longitudinal direction.

Figure 2:
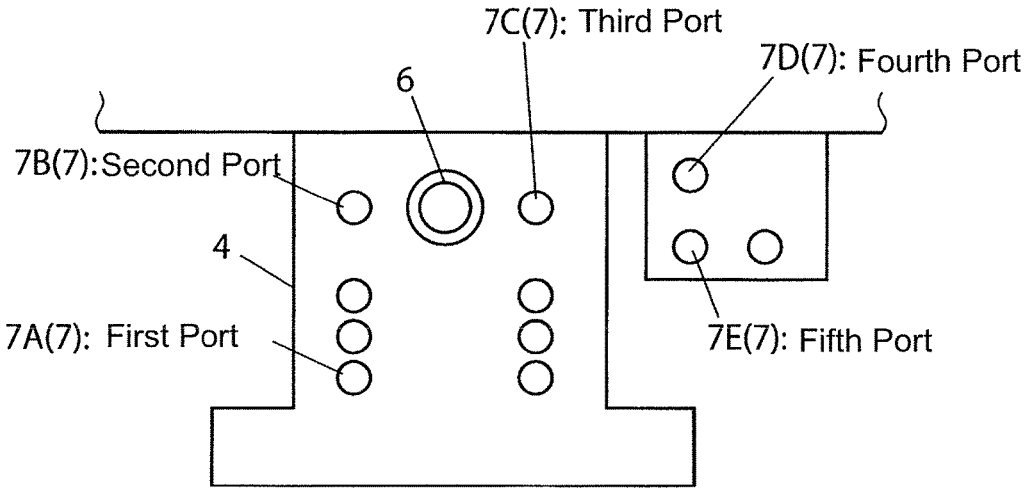
FIG. 2 is a side view illustrating a function of each driving force input port of the power transmission device of the nursing bed illustrated in FIG. 1.

As illustrated FIG. 1 and FIG. 2, a driving mechanism 5 provided to the bed base 4 has a robot arm 6, and a plurality of driving force input ports (rotated driver) 7 to which a distal end portion of the robot arm is selectively connected. The plurality of driving force input ports 7 (7A, 7B, 7C, 7D, 7E) respectively correspond to mutually different moving motions in the upper surface forming member 3 which are described later.

Figure 3:
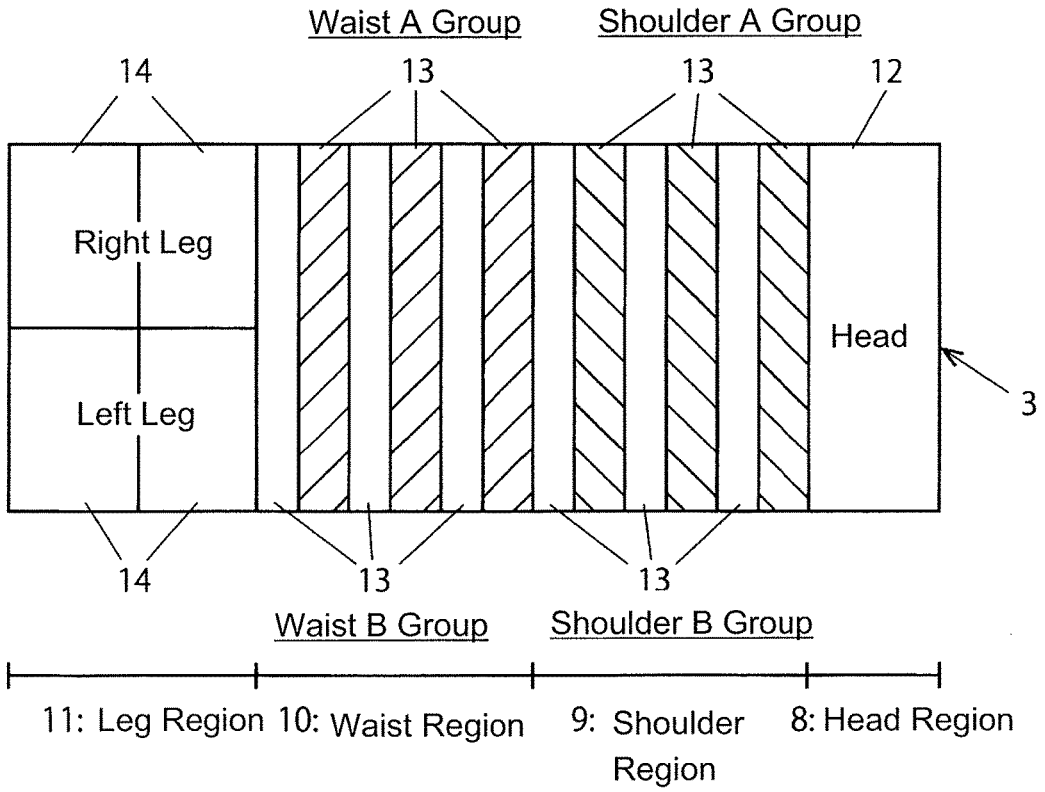
FIG. 3 is a top view schematically illustrating the nursing bed illustrated in FIG. 1.

As illustrated FIG. 1 and FIG. 3, the upper surface forming member 3 of the nursing bed 1 is divided in the longitudinal direction into a head region 8, a shoulder region 9, a waist region 10, and a leg region 11.

The head region 8 of the upper surface forming member 3 is integrally formed by a plate-like rectangular member 12.

The shoulder portion 9 and the waist region 10 in the center portion in the longitudinal direction of the upper surface forming member 3 are respectively configured by juxtaposing a plurality of movable strips 13 extending in the width direction.

The shoulder portion 9 is configured by a shoulder A group configured by a plurality of movable strips 13 which are arranged alternately along the longitudinal direction and a shoulder B group configured by a plurality of movable strips 13 which are arranged between the plurality of movable strips 13 belonging to the shoulder A group.

The plurality of movable strips 13 belonging to the shoulder A group is integrally driven by the driving mechanism 5 in the vertical direction and the horizontal direction, and similarly, the plurality of movable strips 13 belonging to the shoulder B group are integrally driven by the driving mechanism 5 in the vertical direction and the horizontal direction. Also, the shoulder A group and the shoulder B group can be independently driven with each other by the driving mechanism 5.

Also, the waist region 10 is configured by a waist A group configured by a plurality of movable strips 13 which are arranged alternately along the longitudinal direction and a waist B group configured by a plurality of movable strips 13 which are arranged between the plurality of movable strips 13 belonging to the waist A group.

The plurality of movable strips 13 belonging to the waist A group is integrally driven by the driving mechanism 5 in the vertical direction and the horizontal direction, and similarly, the plurality of movable strips 13 belonging to the waist B group are integrally driven by the driving mechanism 5 in the vertical direction and the horizontal direction. Also, the waist A group and the waist B group can be independently driven with each other by the driving mechanism 5.

The leg region 11 is configured by a part corresponding to the right leg and a part corresponding to the left leg. The part corresponding to the right leg is configured by a pair of movable rectangular pieces 14 juxtaposed in the longitudinal direction, and the part corresponding to the left leg is also configured by a pair of movable rectangular pieces 14 juxtaposed in the longitudinal direction.

The part corresponding to the right leg and the part corresponding to the left leg of the leg region 11 are respectively pushed up by the driving mechanism 5 at the center part thereof so as to be risen and deformed in a mountain shape as illustrated in FIG. 1. Thereby, the right leg or the left leg of a care receiver can be pushed up from behind the knee so as to bend the same.

Next, the internal structure of the driving mechanism 5 of the nursing bed 1 according to the embodiment is described.

Figure 4:
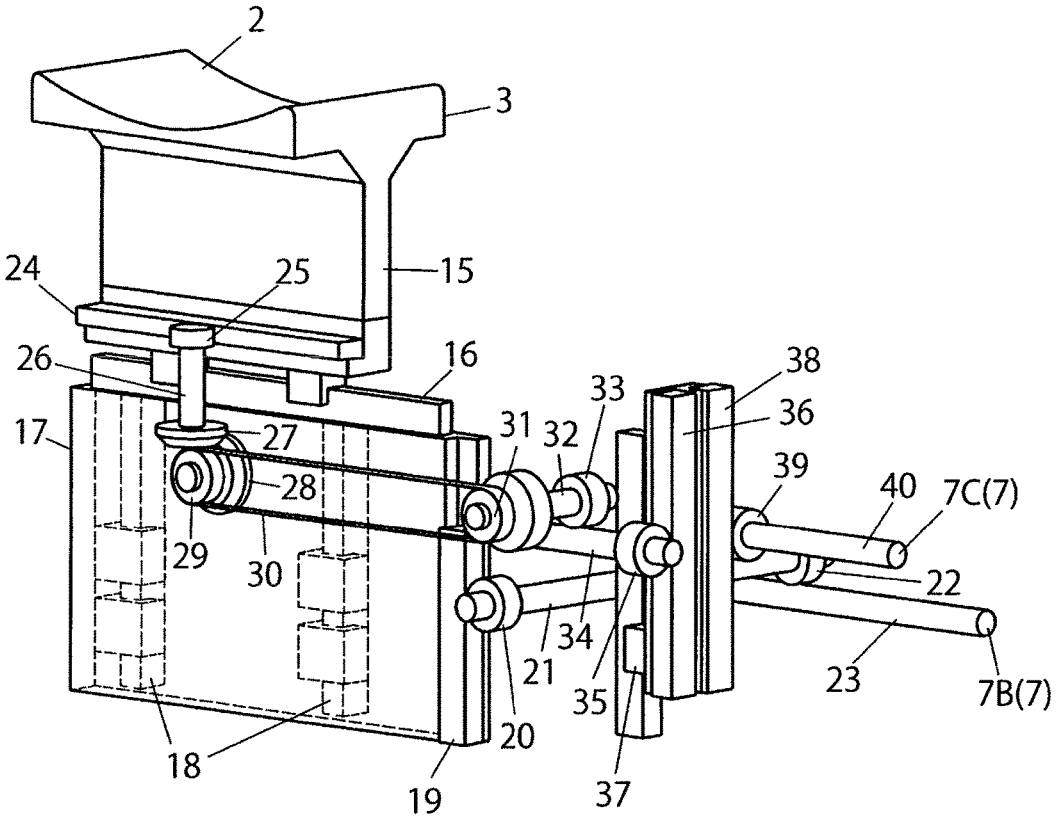
FIG. 4 is a perspective view illustrating a driving mechanism of the power transmission device related to a waist portion and a shoulder portion of the nursing bed illustrated in FIG. 1.

As illustrated in FIG. 4, the driving mechanism 5 has a support base portion 15 whose upper end is provided with (a part of) the upper surface forming member 3. Note that (a part of) the upper surface forming member 3 configured by a plurality of movable strips 13 is schematically illustrated as an integrated object in FIG. 4.

The lower end portion of the support base portion 15 is supported by a linear motion support member (linear guide) 16, and thereby, the support base portion 15 is capable of moving horizontally in the bed left/right direction. The linear motion support member 16, which supports the support base portion 15, is provided to the upper end of a movable support plate 17. The movable support plate 17 is supported so as to be moved vertically by a pair of linear motion support members (linear guide) 18 extended in the vertical direction.

A rack 19 is extended in the vertical direction in one side end portion of the movable support plate 17, and a pinion 20 is engaged with the rack 19. The pinion 20 is provided to one end of a connection shaft 21, and a wheel of a worm gear 22 is provided to the other end of the connection axis 21. The wheel of the worm gear 22 is engaged with a worm of the worm gear 22, and the worm is formed in an input shaft 23 whose distal end portion forms a driving force input port 7. The driving force input port 7 is an input portion of rotational power for vertically moving the upper surface forming member 3.

A rack 24 is provided to the lower end portion of the support base portion 15, and a pinion 25 is engaged with the rack 24. The pinion 25 is provided to the upper end of a connection shaft 26, and a bevel gear 27 is provided to the lower end of the connection shaft 26. This bevel gear 27 is engaged with a bevel gear 28 which is rotatably provided to the movable support plate 17.

A pulley 29 is integrally formed to the bevel gear 28 provided to the movable support plate 17, and a belt 30 is wound on the pulley 29. The belt 30 is wound on another pulley 31 which is provided to one end of a connection shaft 32, and a wheel of a worm gear 33 is provided to the other end of the connection shaft 32. The wheel of the worm gear 33 is engaged with a worm of the worm gear 33.

A pinion 35 is provided to an end portion of a connection shaft 34 where the worm of the worm gear is formed, and this pinion 35 is engaged with a rack 36 extended in the vertical direction. This rack 36 is supported so as to be vertically moved by a linear motion support member (linear guide) 37 extended in the vertical direction. Another rack 38 is supported by the linear motion support member 37 integrally with the rack 36 so as to be moved vertically, and the rack 38 is engaged with a pinion 39.

This pinion 39 is provided to one end of an input shaft 40, and the other end of the input shaft 40 forms the driving force input port 7. This driving force input port 7 is an input portion of rotational power for horizontally moving the upper surface forming member 3 in the left/right direction.

Figure 5:
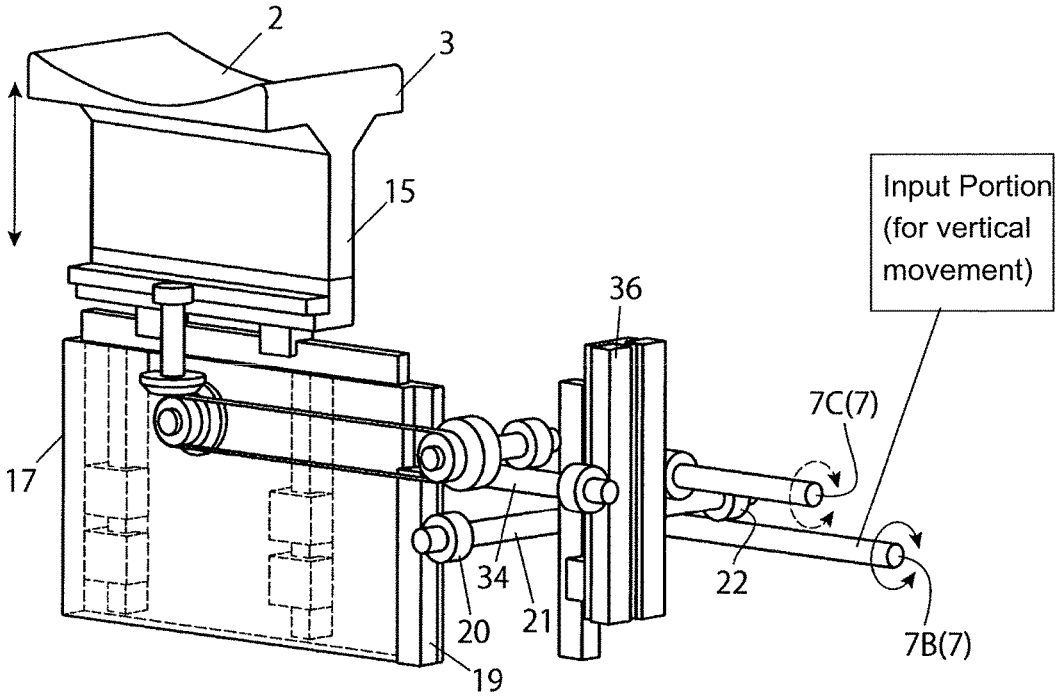
FIG. 5 is a perspective view illustrating the driving mechanism of the power transmission device illustrated in FIG. 4 with respect to an input rotation for an up-and-down motion.

Next, a motion for vertically moving the upper surface forming member 3 of the nursing bed 1 is described with reference to FIG. 5.

When a driving force input port 7B for vertical movement is rotated, this rotational power is transmitted to the connection shaft 21 via the worm gear 22. Then, the pinion 20 is rotated integrally with the connection shaft 21, and the rack 19 is moved in the vertical direction by the rotation of the pinion 20. As the rack 19 is fixed to the movable support plate 17, the movable support plate 17 is moved in the vertical direction together with the rack 19. Thereby, the upper surface forming member 3 is moved in the vertical direction together with the support base portion 15.

Note that, as the connection shaft 34 is vertically moved integrally with the movable support plate 17, the rack 36 is also moved vertically at the same time. Then, a driving force input port 7C for left/right direction movement is rotated, causing no problem since the driving force input port 7C for left/right direction movement is free.

Also, as the worm gear 22 has a structure which cannot be rotated from the output side, its posture can be maintained at the time even when an applied torque of the driving force input port 7B for vertical movement is removed.

Figure 6:
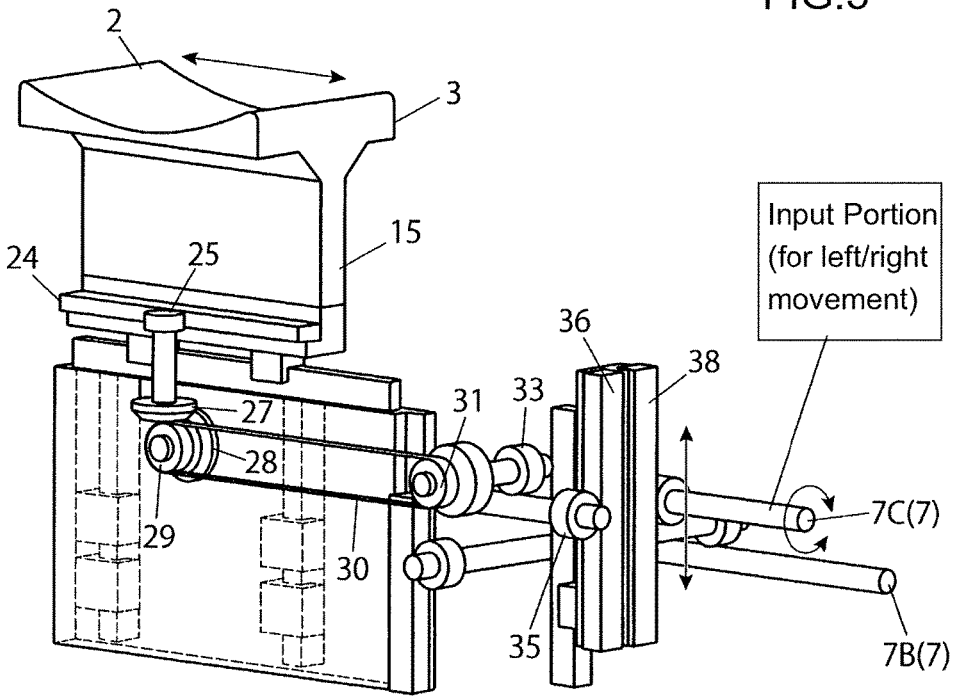
FIG. 6 is a perspective view illustrating the driving mechanism of the power transmission device illustrated in FIG. 4 with respect to an input rotation for a side-to-side motion.

Next, a motion for horizontally moving the upper surface forming member 3 of the nursing bed 1 in the left/right direction is described with reference to FIG. 6.

When the driving force input port 7C for left/right direction movement is rotated, this rotational force is transmitted to the rack 38, and the rack 38 is moved in the vertical direction together with the other rack 36. The pinion 35 is rotated according to vertical movements of the rack 36, and this rotational force is transmitted to the pulley 31 via the worm gear 33.

When the pulley 31 is rotated, the other pulley 29 is rotated at the same time via the belt 30. Thereby, the bevel gear 28, which is integrally provided to the pulley 29, is rotated, and thereby the bevel gear 27 engaged with this bevel gear 28 is rotated.

When the bevel gear 27 is rotated, the pinion 25 is rotated at the same time, and the rack 24 is rotated in the left/right direction by the rotation of the pinion 25. As a result, the upper surface forming member 3 is horizontally moved in the left/right direction together with the support base portion 15.

Note that, as the worm gear 33 has a structure which cannot be rotated from the output side, its posture can be maintained at the time even when an applied torque of the driving force input port 7C for left/right direction movement is removed.

Figure 7:
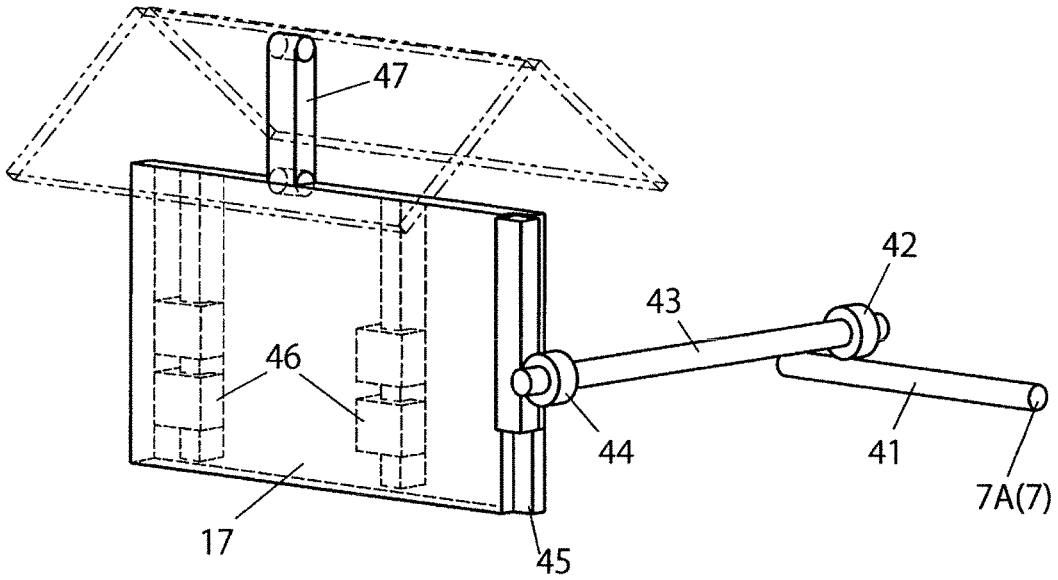
FIG. 7 is a perspective view illustrating the driving mechanism of the power transmission device related to a leg region of the nursing bed illustrated in FIG. 1.

FIG. 7 illustrates the driving mechanism for the leg portion for pushing up the movable rectangular piece 14 configuring the leg region 11 from below. In this driving mechanism for the leg portion, when a driving force input port 7A (7) for the leg portion is rotated, an input shaft 41, whose distal end portion is provided with the driving force input port 7A, is rotated.

A worm, which configures a worm gear 42, is formed in the input shaft 41 so that power is transmitted to a wheel which also configures the worm gear 42. The wheel of the worm gear 42 is provided to one end of a connection shaft 43, and a pinion 44 is provided to the other end of the connection shaft 43.

The pinion 44 is engaged with a rack 45 which is provided to a side end portion of the movable support plate 17. The movable support plate 17 is supported so as to be moved vertically by a pair of linear motion support members (linear guide) 46 extended in the vertical direction.

The rack 45 is moved vertically by a rotation of the pinion 44, and thereby the movable support plate 17 is moved vertically. The lower end portion of a push-up member 47 is fixed to the upper end portion of the movable support plate 17, and the movable rectangular piece 14 is pushed up from below the same by the upper end portion of the push-up member 47.

Next, a power transmission device 50 configured including the robot arm 6 and the driving force input port 7 is described. This power transmission device 50 configures a part of the driving mechanism of the nursing bed.

Figure 8:
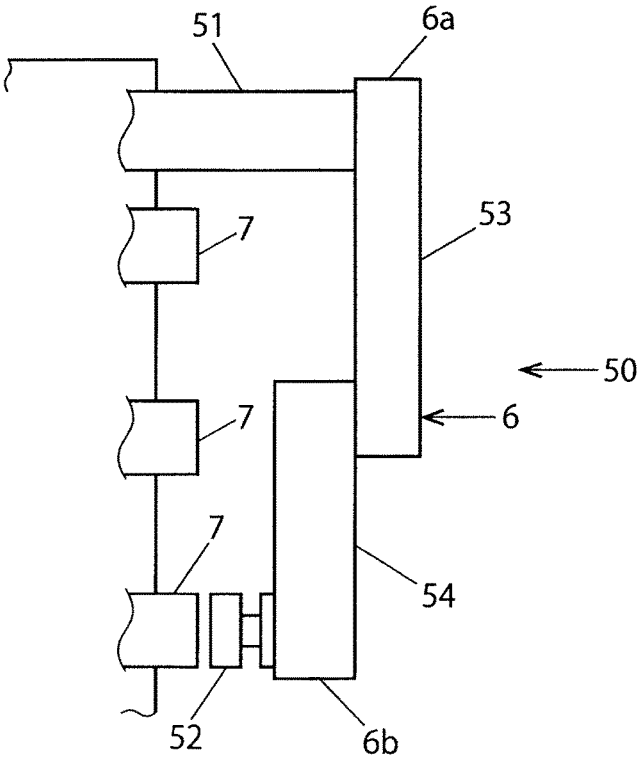
FIG. 8 is a side view illustrating a state in which rotational power is being connected to the driving force input port of the power transmission device of the nursing bed illustrated in FIG. 1.
Figure 9:
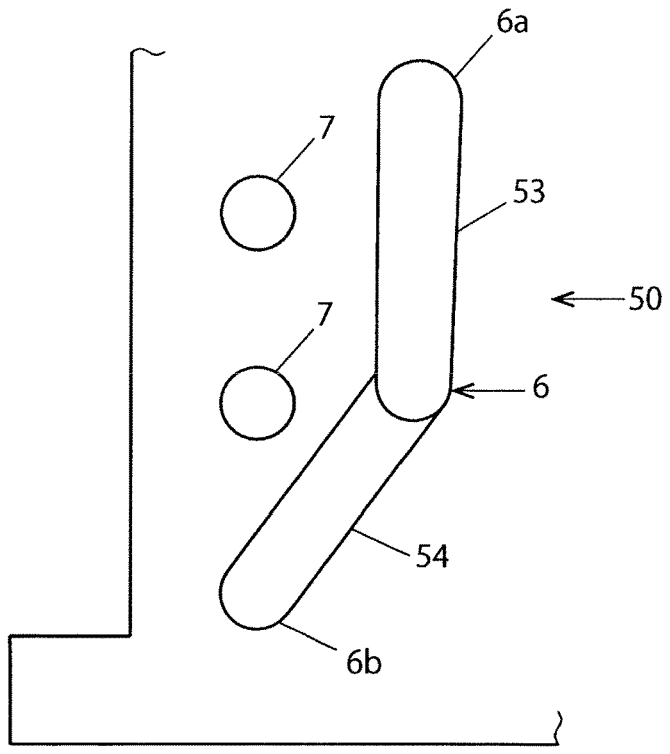
FIG. 9 is a front view illustrating a state in which the rotational power is being connected to the driving force input port of the power transmission device of the nursing bed illustrated in FIG. 1.

As illustrated in FIG. 8 and FIG. 9, the robot arm 6 has a proximal end portion 6*a* and a distal end portion 6*b*, and the proximal end portion 6*a* of the robot arm 6 is mounted on the upper end portion of a robot main shaft 51. A rotational driver 52 is rotatably provided to the distal end portion 6*b* of the robot arm 6.

The robot arm 6 has a proximal end side link member 53 and a distal end side link member 54. The proximal end portion of the proximal end side link member 53 configures the proximal end portion 6*a* of the robot arm, and the distal end portion of the distal end side link member 54 configures the distal end portion 6*b* of the robot arm 6. The distal end portion of the proximal end side link member 53 and the proximal end portion of the distal end side link member 54 are rotatably connected with each other.

Figure 10:
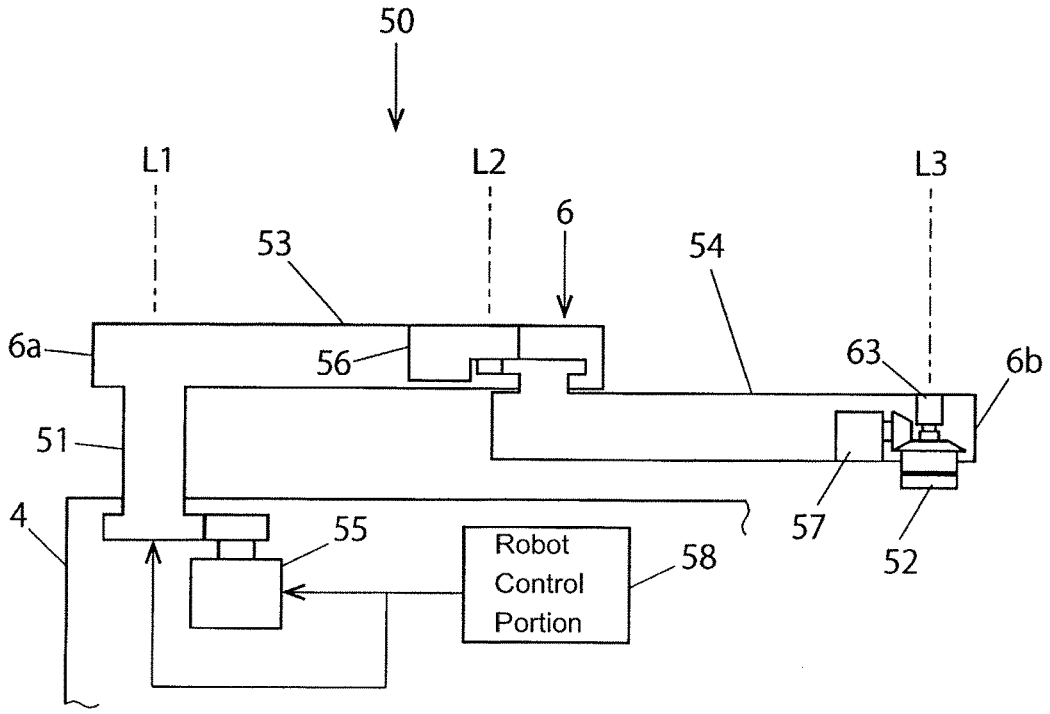
FIG. 10 is a cross-sectional view illustrating an internal structure of a robot arm of the power transmission device of the nursing bed illustrated in FIG. 1.

As illustrated in FIG. 10, a driving motor 55 for the robot main shaft 51 is provided inside the bed base 4, and the robot main shaft 51 is rotationally driven about a first axis line L1 by this driven motor 55.

A driving motor 56 for the distal end side link member 53 is provided inside the proximal end side link member 53, and the distal end side link member 54 is rotationally driven about a second axis line L2 by this driving motor 56.

A driving motor 57 for the rotational driver 52 is provided inside the distal end side link member 54, and the rotational driver 52 is rotationally driven about a third axis line L3 by this driving motor 57.

Note that the first axis line L1, the second axis line L2, and the third axis line L3 are parallel to one another.

The respective driving motors 55, 56, and 57 are controlled about their rotations by a robot control portion 58. The robot control portion 58 can store a program particular to a given care receiver so as to realize a bedsore-prevention-motion particular to the care receiver.

Figure 11:
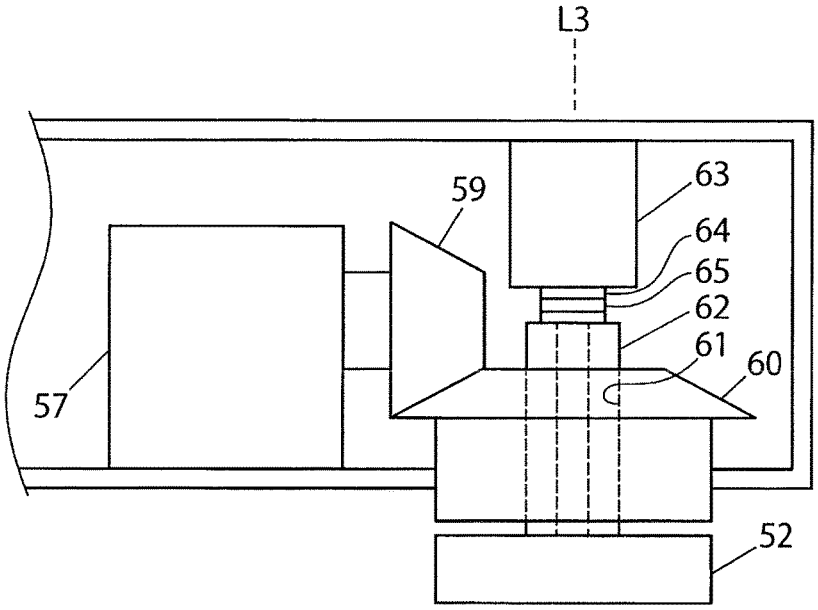
FIG. 11 is an enlarged sectional view illustrating a distal end portion of the robot arm illustrated in FIG. 10.

As illustrated in FIG. 11, a bevel gear 59 on the driving motor 57 side and a bevel gear 60 on the rotational driver 52 are engaged with each other. A through hole 61 including a spline groove is formed at the center of the bevel gear 60 on the rotational driver 52 side, and a rotational driving shaft 62 is inserted through the through hole 61 so as to be capable of moving along the third axis line L3. The rotational driving shaft 62 is spline-fitted to the through hole 61 of the bevel gear 60, and thereby the rotational driving shaft 62 is prevented from rotating about the third shaft line L3 with respect to the bevel gear 60 and allowed to perform liner motion movements along the third axis line L3.

The rotational driver 52 is mounted on one end portion of the rotational driving shaft 62, and a distal end portion of a piston 64 of an air cylinder 63 is connected to the other end portion of the rotational driving shaft 62 via a bearing 65. The rotational driver 52 moves forward along the third axis line L3 together with the rotational driving shaft 62 by driving the air cylinder 63 to advance the piston 64.

When the driving motor 57 is driven, its rotational force is transmitted to the bevel gear 60 on the rotational driver 52 side from the bevel gear 59 on the driving motor 57 side. As the rotational driving shaft 62 of the rotational driver 52 and the bevel gear 60 are spline-fitted to each other, the rotational driving force of the bevel gear 60 is transmitted to the rotational driving shaft 62, and thereby the rotational driver 52 is rotated integrally with the rotational driving shaft 62.

Next, a connection mechanism for connecting the driving force input port 7 on the bed base 4 side and the rotational driver 52 on the robot arm 6 side is described with reference to FIGS. 12 to 14.

When driving the air cylinder 63 so as to connect the rotational driver 52 on the distal end of the robot arm 6 to the driving force input port 7 on the bed base 4 side, it is necessary to absorb a positioning error of the rotational driver 52 to the driving force input port 7 and a deviation of a mechanical tolerance (such as eccentricity) of the rotational driver 52 and the driving force input port 7, and it is also necessary to perform the same with a coupling.

Figure 12:
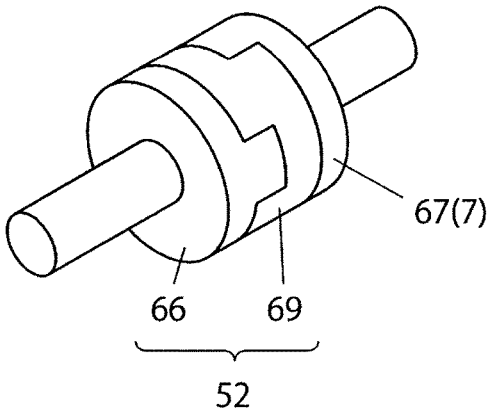
FIG. 12 is a perspective view illustrating the power transmission device of the nursing bed illustrated in FIG. 1 under a state in which the driving force input port and a rotational driver on the distal end of the robot arm are connected to each other.
Figure 13:
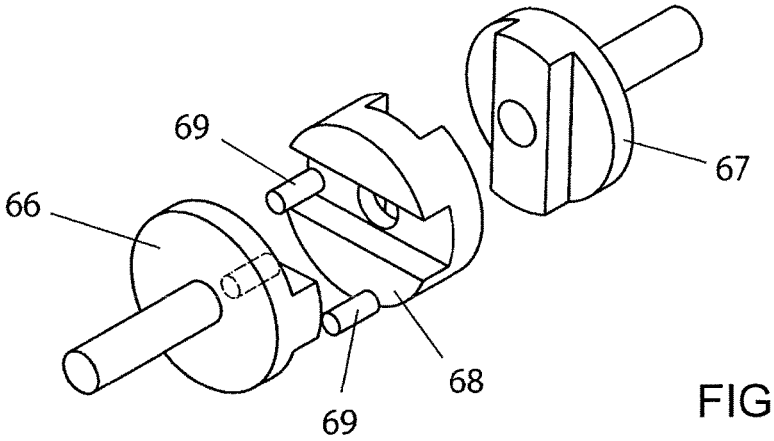
FIG. 13 is an assembly drawing illustrating the power connection portion of the nursing bed illustrated in FIG. 12.
Figure 14:
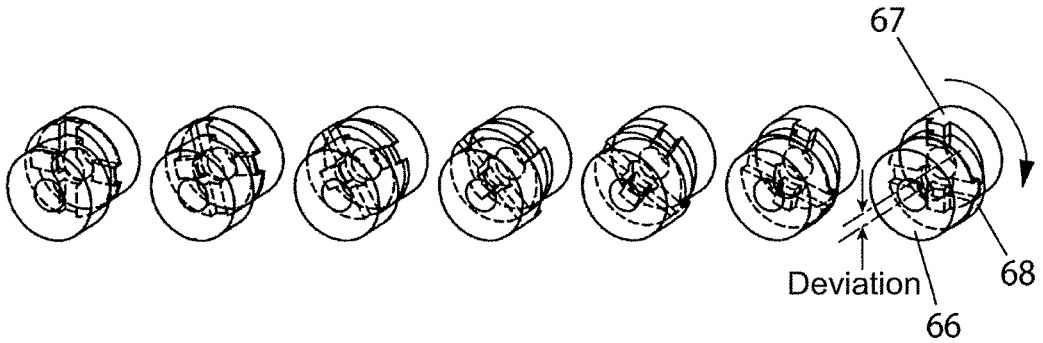
FIG. 14 is a view illustrating the power connection portion of the nursing bed illustrated in FIG. 12 under a state in which backlash (such as eccentricity) is being absorbed during connection.

Thus, in the embodiment, an oldham coupling is employed so as to absorb the deviation as illustrated in FIG. 12 and FIG. 13. Namely, in the oldham coupling, projections of its hubs 66, 67 slide in grooves of the slider 68 so as to absorb a deviation (refer to FIG. 14). Note that the hub 66 and the slider 68 configure the rotational driver 52, and the hub 67 configures the driving force input port 7.

Here, in the power transmission device 50 of the embodiment, the slider 68 is mounted to the hub 66 on the robot arm 6 side so as to be free in the horizontal direction for attaching/detaching of a driving side and a driven side, and a spring 69 is interposed between the hub 66 on the robot arm 6 side and the slider 68 for mitigating impact in the axis direction when coupling.

Next, an operation example of the power transmission device 50 of the nursing bed according to the present embodiment is described.

The robot arm is driven, and thereby the rotational driver 52 on the distal end of the arm is brought and positioned close to a desired driving force input port 7 so as to face the same. The air cylinder 63 on the distal end of the robot arm 6 is driven, and thereby the rotational driver 52 is advanced toward the driving force input port 7 along the third axis line L3 so that both are engaged with each other. Then, a stroke length of the air cylinder 63 is detected so as to confirm that the rotational driver 52 and the driving force input port 7 are normally engaged with each other.

Next, the driving motor 57 on the distal end of the robot arm 6 is driven so as to rotate the rotational driver 52. As the rotational driver 52 is connected to the driving force input port 7, the rotational force from the rotational driver 52 is transmitted to the driving force input port 7. As a result, the part of the upper surface forming member 3 corresponding to the driving force input port 7 performs a predetermined operation.

After rotating the driving force input port 7 by a predetermined amount, the driving motor 57 is stopped. The air cylinder 63 is driven, and thereby the rotational driver 52 is brought back so as to separate the rotational driver 52 from the driving force input port 7. The robot arm 6 is driven, and thereby the rotational driver 52 is moved to the next driving force input port 7 so as to be positioned with respect to the same.

Next, an operation example of the nursing bed according to the present embodiment, namely the shape change method is described.

The rotational driver 52 on the distal end of the robot arm 6 is connected to the first driving force input port 7A (corresponding to the right knee) so as to rotate the driving motor 57. Thereby, the rotational driving force from the rotational driver 52 is transmitted to a driving system of a part corresponding to the right knee of the upper surface forming member 3 of the nursing bed 1. As a result, the part corresponding to the right knee is deformed in a mountain shape.

After stopping the rotation of the driving motor 57, the air cylinder 63 is driven so as to separate the power connection portion (the rotational driver 52 and the driving force input port 7), and the robot arm 6 is driven so as to connect the rotational driver 52 on the distal end of the robot arm 6 to the second driving force input port 7B (corresponding to up-and-down motions of the waist A group).

In this state, the driving motor 57 is rotated. Thereby, the rotational driving force from the rotational driver 52 is transmitted to an up-and-down driving system of a part corresponding to the waist A group of the upper surface forming member 3 of the nursing bed 1. As a result, the part corresponding to the waist A group rises.

After stopping the rotation of the driving motor 57, the air cylinder 63 is driven so as to separate the power connection portion, and the robot arm 6 is driven so as to connect the rotational driver 52 on the distal end of the robot arm 6 to the third driving force input port 7C (corresponding to horizontal motions of the waist A group).

In this state, the driving motor 57 is rotated. Thereby, the rotational driving force from the rotational driver 52 is transmitted to a horizontal driving system of the part corresponding to the waist A group of the upper surface forming member 3 of the nursing bed 1. As a result, the part corresponding to the waist A group is moved horizontally.

After stopping the rotation of the driving motor 57, the air cylinder 63 is driven so as to separate the power connection portion, and the robot arm 6 is driven so as to connect the rotational driver 52 on the distal end of the robot arm 6 to the forth driving force input port 7D (corresponding to up-and-down motions of the shoulder A group).

In this state, the driving motor 57 is rotated. Thereby, the rotational driving force from the rotational driver 52 is transmitted to an up-and-down driving system of a part corresponding to the shoulder A group of the upper surface forming member 3 of the nursing bed 1. As a result, the part corresponding to the shoulder A group rises.

After stopping the rotation of the driving motor 57, the air cylinder 63 is driven so as to separate the power connection portion, and the robot arm 6 is driven so as to connect the rotational driver 52 on the distal end of the robot arm 6 to the fifth driving force input port 7E (corresponding to horizontal motions of the shoulder A group).

In this state, the driving motor 57 is rotated. Thereby, the rotational driving force from the rotational driver 52 is transmitted to a horizontal driving system of the part corresponding to the shoulder A group of the upper surface forming member 3 of the nursing bed 1. As a result, the part corresponding to the shoulder A group is moved horizontally.

After stopping the rotation of the driving motor 57, the air cylinder 63 is driven so as to separate the power connection portion, and the robot arm 6 is driven so as to connect the rotational driver 52 on the distal end of the robot arm 6 to the third driving force input port 7C (corresponding to horizontal motions of the waist A group).

In this state, the driving motor 57 is rotated. Thereby, the rotational driving force from the rotational driver 52 is transmitted to a horizontal driving system of the part corresponding to the waist A group of the upper surface forming member 3 of the nursing bed 1. As a result, the part corresponding to the waist A group is further moved horizontally.

After stopping the rotation of the driving motor 57, the air cylinder 63 is driven so as to separate the power connection portion, and the robot arm 6 is driven so as to connect the rotational driver 52 on the distal end of the robot arm 6 to the fifth driving force input port 7E (corresponding to horizontal motions of the shoulder A group).

In this state, the driving motor 57 is rotated. Thereby, the rotational driving force from the rotational driver 52 is transmitted to the horizontal driving system of the part corresponding to the shoulder A group of the upper surface forming member 3 of the nursing bed 1. As a result, the part corresponding to the shoulder A group is further moved horizontally.

The robot is taught as mentioned above so as to program a bedsore prevention operation suitable for a care receiver. The above-mentioned operation example is the case that the trunk in the shoulder portion and the waist portion is shifted to the left. Further, for shifting the trunk to the right, the above-mentioned procedure is performed inversely so as to once return the trunk straight, and further the driving force input port corresponding to the left knee is selected so as to change posture.

Note that, the upward and downward directions of the up-and-down operation and the right and left directions of the horizontal operation are switched by a forward/reverse rotation of the driving motor 57.

As described above, by the nursing bed 1 having the power transmission device 50 of the present embodiment and its shape change method, the body of a care receiver can be moved in a horizontal direction in a state that the body of the care receiver is supported by the curved surface of the bed upper surface 2 from below so as to gently shift the body of the care receiver in a natural state, enabling the centroid point of the trunk with respect to the bed to be changed, and as a result a gentle rotation of the trunk in a natural state can be expected. Thereby, a natural motion similar to a turning movement during sleep in bed is realized so as to minimize a burden on the body of the care receiver when changing posture and also prevent bedsores.

Also, the robot arm 6 is driven by a program previously installed in the robot control portion 58 so as to automatically perform a predetermined bedsore prevention operation, and therefore a caregiver does not need to perform works periodically in midnight or the like, relieving mental and physical burden on the caregiver and also relieving a mental burden on the care receiver for the caregiver.

Also, by positioning the robot arm 6, the rotational force can be selectively transmitted to a plurality of driving force input ports 7 by the common rotational driver 52, thereby enabling one drive source to realize a plurality of different operations so as to simplify the configuration.

Also, by changing teaching contents for the robot, a specifying order (sequence) of a supply point (the driving force input port 7) of driving force can be easily changed, and therefore flexibility for realizing the plurality of different operations can be enhanced.

Also, as the robot arm 6 itself performs the function of switching power transmission to the plurality of driving force input ports 7, a conventional clutch mechanism for switching a destination of power transmission can be eliminated.

Next, as a modified example of the nursing bed 1 according to the above-mentioned embodiment and its shape change method, the parts of the upper surface forming member 3 in the shoulder region 9 and the waist region 10 may be moved in the left/right direction not horizontally but along the curved surface (bed upper surface 2) of the upper surface forming member 3.

Figure 15:
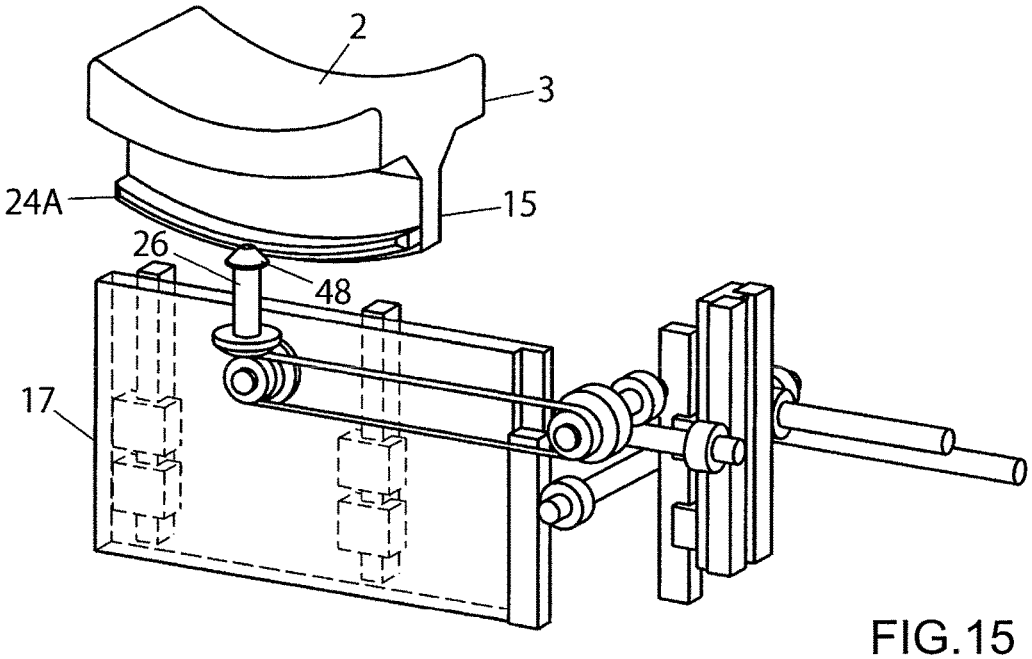
FIG. 15 is a perspective view illustrating a modified example of the driving mechanism of the power transmission device related to the waist portion and the shoulder portion of the nursing bed illustrated in FIG. 1.

Specifically, as illustrated in FIG. 15, a curved rack 24A having the same curvature as that of the curved surface of the upper surface forming member 3 is provided to the lower end portion of the support base portion 15 whose upper end is provided with the upper surface forming member 3. A bevel gear 48 provided to the upper end of a connection shaft 26A is engaged with the curved rack 24A.

The lower end portion of the support base portion 15 is curved at the same curvature as that of the curved surface (bed upper surface 2) of the upper surface forming member 3, and the lower end portion of the support base portion 15 is supported so as to be moved along its curved surface by a plurality of roller members (not shown) provided to the upper end of the movable support plate 17.

In this modified example, the rack 24A is moved in the left/right direction along the curved surface (bed upper surface 2) of the upper surface forming member 3. Thereby, the bed upper surface 2 of the upper surface forming member 3 is moved in the left/right direction along its curved surface.

As described above, in the modified example, the bed upper surface 2 of the upper surface forming member 3 is moved in the left/right direction along its curved surface, and therefore the body of the care receiver can be gently shifted in the state that the body of the care receiver is supported by the curved surface of the bed upper surface 2 from below while suppressing generation of local stress and rotating the body of the care receiver in a further natural state. Thereby, a natural motion similar to a turning movement during sleep in bed can be realized so as to minimize a burden on the body of the care receiver when changing posture and also prevent bedsores.

Figure 16:
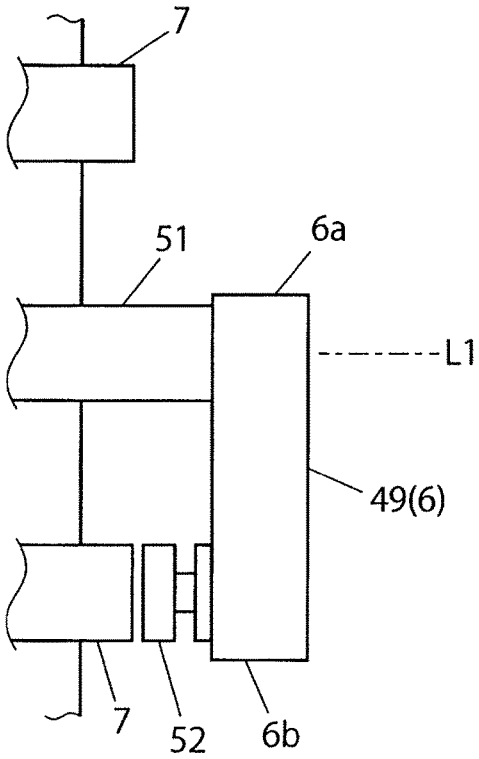
FIG. 16 is a side view illustrating a modified example of the driving force input port and the robot arm of the power transmission device of the nursing bed illustrated in FIG. 1.
Figure 17:
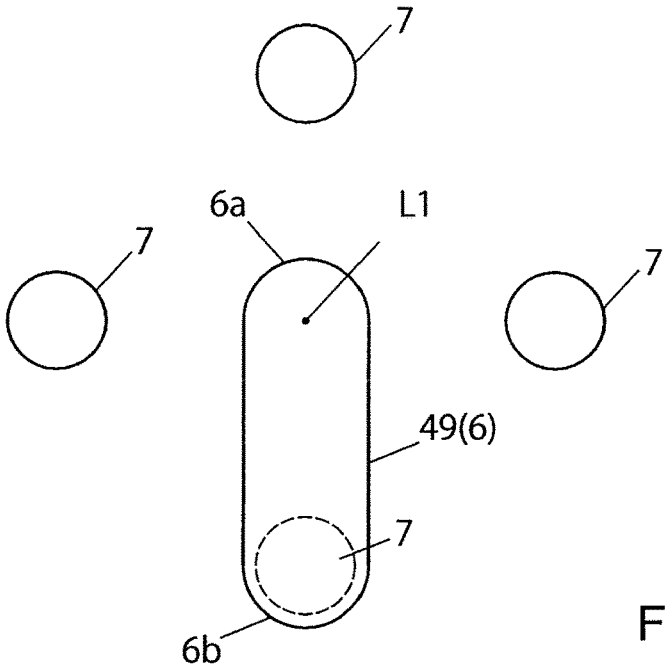
FIG. 17 is a front view illustrating the driving force input port and the robot arm illustrated in FIG. 16.

As another modified example of the above-described embodiment, the robot arm 6 can be configured by a single link member including the proximal end portion 6*a* and the distal end portion 6*b*. Namely, as illustrated in FIGS. 16 and 17, the base end portion of the one link member 49 is mounted on the upper end portion of the robot main shaft 51 and the rotational driver 52 is provided to the distal end portion of the same link member 49.

Also, the plurality of driving force input ports 7 are arranged on a virtual circle having the rotational axis line (the first axis line L1) of the robot main shaft 51 as its center. In this configuration, the robot arm 6 is turned by the rotation of the robot main shaft 51 so that the rotational driver 52 on the distal end portion of the robot arm 6 can be positioned in front of a desired driving force input port 7.

Note that, also in the modified example, the connection mechanism for the rotational driver 52 and the driving force input port 7 is the same as that of the above-described embodiment.

Figure 18:
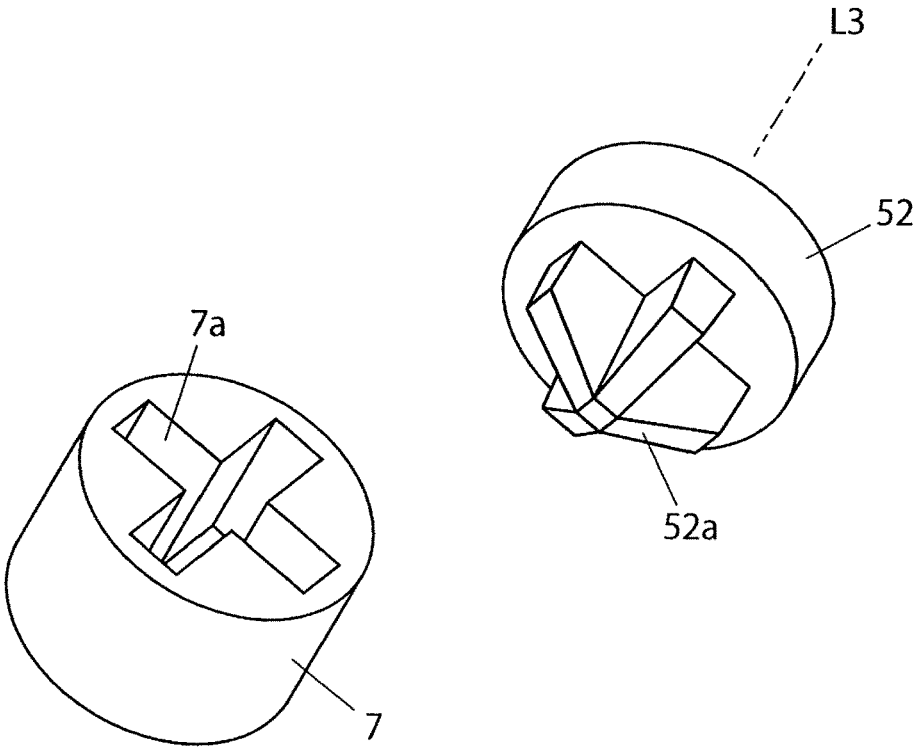
FIG. 18 is a perspective view illustrating a modified example of the power connection portion of the power transmission device of the nursing bed illustrated in FIG. 1.

As another modified example of the above-described embodiment, as illustrated in FIG. 18, a cross-shaped connecting recessed portion 7*a* is formed in the driving force input port 7, and also a cross-shaped connecting projecting portion 52*a* is formed in the rotational driver 52. The connecting recessed portion 7*a* and the connecting projecting portion 52*a* respectively have a dimension and a shape to be gently fitted to each other.

Also, as illustrated in FIG. 18, the connecting projecting portion 52*a* has a tapered shape, on the other hand, the connecting recessed portion 7*a* has an inclined shape corresponding to the tapered shape of the connecting projecting portion 52*a*.

In this connecting method, the connecting projecting portion 52*a* of the rotational driver 52 is fitted to the connecting recessed portion 7*a* formed in the driving force input port 7 from the front thereof. Then, the tapered shape of the connecting projecting portion 52*a* and the inclined shape of the connecting recessed portion 7*a* are engaged with each other so as to exert a positioning function in the direction that a positioning error of the rotational driver 52 to the driving force input port 7 or the like is absorbed, thereby achieving a natural engagement.

As another modified example of the above-described embodiment, a connecting method of the rotational driver 52 and the driving force input port 7 may be configured so as to connect them by bringing the both close to each other along the direction orthogonal to the rotational axis line (the third axis line L3).

Figure 19:
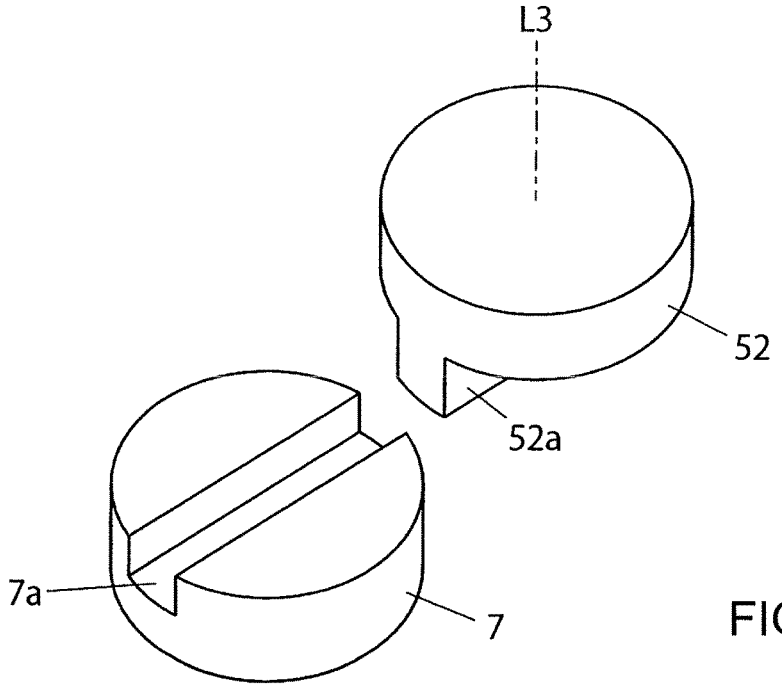
FIG. 19 is a perspective view illustrating a modified example of the power connection portion of the power transmission device of the nursing bed illustrated in FIG. 1.

Specifically, as illustrated in FIG. 19, the connecting recessed portion 7*a* is formed in the driving force input port 7 along its diametrical direction, and also the connecting projecting portion 52*a* is formed in the rotational driver 52 along its diametrical direction. The connecting recessed portion 7*a* and the connecting projecting portion 52*a* have dimensions and shapes to be gently fitted to each other.

In this connecting method, as illustrated in FIG. 19, the connecting projecting portion 52*a* of the rotational driver 52 can be fitted to the connecting recessed portion 7*a* formed in the driving force input port 7 from its side. Thus, when connecting to the driving force input port 7, the rotational driver 52 does not need to be advanced in the rotational axis line (the third axis line L3) direction, and therefore the air cylinder 63 or the like can be omitted, thereby simplifying the structure.

As another modified example of the above-described embodiment, a plurality of driving force input ports 7 of two nursing bed 1 may be configured so as to be selectively driven by the rotational driver 52 of the common robot arm 6.

Figure 20:
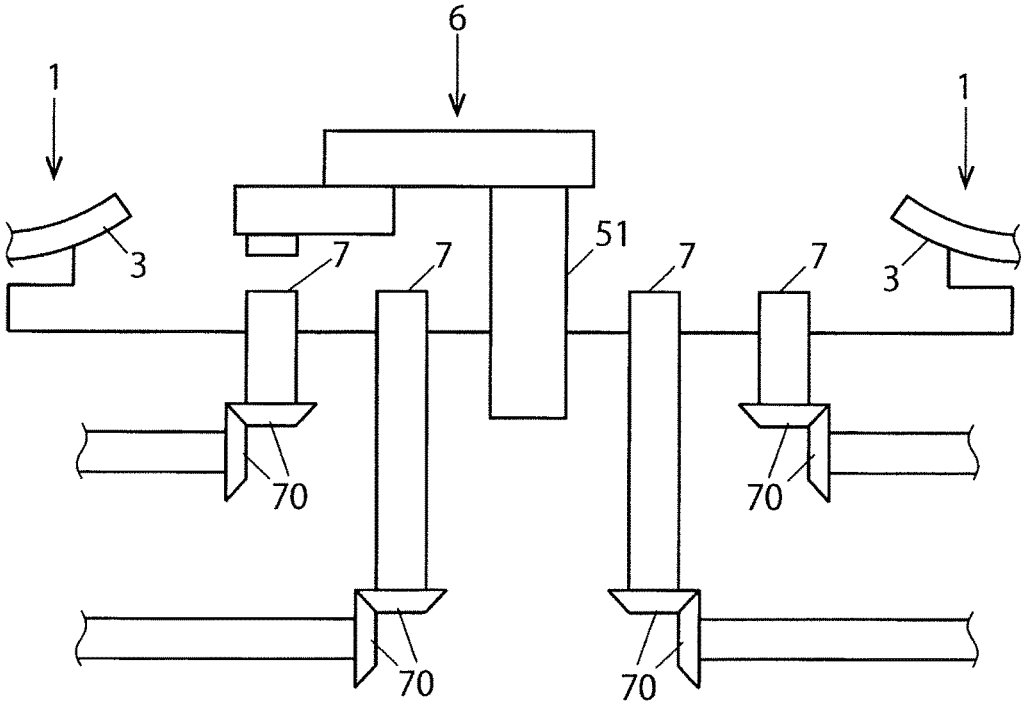
FIG. 20 is a cross-sectional view illustrating a modified example of the power transmission device of the nursing bed illustrated in FIG. 1 which is configured so that a robot drives each driving force input port of two nursing beds.

Namely, in the modified example, as illustrated in FIG. 20, two upper surface forming members 3 of two nursing beds 1 and their driving mechanisms (except for the robot arm portion) are arranged respectively. The robot main shaft 51 is arranged in the vertical direction, and each driving force input port 7 is also arranged in the vertical direction via the bevel gear 70.

Also, in the modified example, by rotationally driving the robot arm 6 in the horizontal direction so as to position the same to a desired driving force input port 7, a plurality of driving force input ports 7 of one nursing bed 1 and a plurality of driving force input ports 7 of the other nursing bed 1 can be rotationally driven selectively by the rotational driver 52 of the common robot arm 6.

As another modified example of the above-described embodiment, for advancing and retreating the rotational driver 52 on the distal end of the robot arm 6, a mechanism for moving the robot main shaft 51 along its rotational axis line may be provided instead of the mechanism that an air cylinder is provided on an arm distal end, so as to move the robot arm 6 as a whole by advance/retreat operation of the robot main shaft 51.

As another modified example of the above-described embodiment, a connecting mechanism of the rotational driver 52 and the driving force input port 7 may be configured so that an air cylinder or the like is provided on the driving force input port 7 side so as to drive the driving force input port 7 forward and backward with respect to the rotational driver 52, instead of the method that the rotational driver 52 is driven forward and backward to the driving force input port 7.

As another modified example of the above-described embodiment, with respect to a connecting method of the power connection portion (driving force input port 7 and rotational driver 52), a friction plate may be provided to the rotational driver 52 on the distal end of the robot arm 6 and also the friction plate may be provided to the driving force input port 7 as well, instead of the method that a recessed portion and a projecting portion are fitted to each other as mentioned above.

In the modified example, by pressing the rotational driver 52, while rotating the same, against the driving force input port 7, the both friction plates are engaged with each other so as to achieve the connected state. Thus, sliding is generated between the friction plates during connection, and therefore power is transmitted smoothly. Thereby, operation of the upper surface forming member 3 also becomes smooth, enabling a burden on a care receiver to be further reduced.

Additionally, as another connecting method of the power connection portion (driving force input port 7 and rotational driver 52), a method that the rotational driver 52 and the driving force input port 7 are connected to each other by magnetic force may be employed.

Next, various modified examples of the above-mentioned power transmission device 50 of the nursing bed 1 are described.

In the above-described embodiment, the driving motor 57 is installed on the distal end of the robot arm 6 so as to supply its rotational driving force to each driving force input port 7. Instead of this configuration, a plurality of driving motors may be installed on the bed base 4 side for each part of the upper surface forming member 3 so that the robot arm 6 performs clutch switching when transmitting the driving force to each part. In this case, a switch for operating the clutch is installed on the bed base 4 side instead of the driving force input port 7.

Also, a single driving motor may be installed on the bed base 4 side so that the robot arm 6 performs clutch switching when distributing/transmitting the driving force to each part. In that case, a switch for operating the clutch is installed on the bed base 4 side instead of the driving force input port 7.

Also, the driving method may be air driving (air bag, air cylinder, or the like) instead of motor rotation, regardless of whether the drive source is on either the robot side or the bed base 4 side, or either a single or a plurality of driving source/sources is/are installed.

Also, the robot as a switching mechanism of driving force may be mounted on a mobile carriage without being installed on the bed base 4 side.

Also, the switching mechanism of driving force may be configured so as to switch driving force by a sequencer without using the robot.

EXPLANATION OF REFERENCE NUMERALS

1 . . . nursing bed
2 . . . bed upper surface
3 . . . upper surface forming member
4 . . . bed base
5 . . . driving mechanism
6 . . . robot arm
6*a* . . . proximal end portion of robot arm
6*b* . . . distal end portion of robot arm
7 . . . driving force input port

8 . . . head region
9 . . . shoulder region
10 . . . waist region
11 . . . leg region
12 . . . rectangular member
13 . . . movable strip
14 . . . movable rectangular piece
15 . . . support base portion
16, 18, 37, 46 . . . linear motion support member (linear guide)
17 . . . movable support plate
19, 24, 24A, 36, 38, 45 . . . rack
20, 25, 35, 39, 44 . . . pinion
21, 26, 32, 34, 43 . . . connection shaft
22, 33, 42 . . . worm gear
23, 40, 41 . . . input shaft
27, 28, 48, 59, 60, 70 . . . bevel gear
29, 31 . . . pulley
30 . . . belt
47 . . . push-up member
49 . . . link member
50 . . . power transmission device
51 . . . robot main shaft
52 . . . rotational driver
53 . . . proximal end side link member
54 . . . distal end side link member
55, 56, 57 . . . driving motor
58 . . . robot control portion
61 . . . through hole
62 . . . rotational driving shaft
63 . . . air cylinder
64 . . . piston
65 . . . bearing
66, 67 . . . hub of oldham coupling
68 . . . slider of oldham coupling
69 . . . spring
L1 . . . first axis line
L2 . . . second axis line
L3 . . . third axis line

The invention claimed is:

1. A nursing bed with a dimension in a longitudinal direction and a dimension in a width direction, comprising:
an upper surface forming member which forms a bed upper surface on which a care receiver lies;
a driving mechanism configured to move at least a portion of the upper surface forming member; and
a robot arm,
wherein the bed upper surface includes a curved surface which is curved downwardly in the width direction,
wherein the driving mechanism is configured so that a rotational driving force is transmitted from a rotational driver mounted on a distal end portion of the robot arm,
wherein the driving mechanism has a plurality of rotated drivers which are selectively and separatably connected to the rotational driver, the plurality of rotated drivers being respectively installed corresponding to mutually different moving motions in the upper surface forming member, and
wherein the robot arm is configured to move in both left-right and up-down directions so as to allow the rotational driver to engage with any of the plurality of rotated drivers.

2. The nursing bed according to claim 1, wherein the driving mechanism is configured to move the at least a portion of the upper surface forming member along the curved surface.

3. The nursing bed according to claim 1, wherein the curved surface is an arc surface which configures a portion of a virtual cylinder surface with a center axis line extending along the longitudinal direction.

4. The nursing bed according to claim 1, wherein the driving mechanism is configured to move the at least a portion of the upper surface forming member in a horizontal direction.

5. The nursing bed according to claim 1, wherein the at least a portion of the upper surface forming member is configured by juxtaposing in the longitudinal direction a plurality of movable strips extending in the width direction.

6. The nursing bed according to claim 5, wherein the driving mechanism has a unit configured to move at least a portion of the plurality of movable strips in a vertical direction and a unit configured to move the at least a portion of the plurality of movable strips which has been moved upwardly along the curved surface or in the horizontal direction.

7. The nursing bed according to claim 5, wherein the plurality of movable strips are classified into at least two groups and configured to move a plurality of movable strips belonging to each of the at least two groups simultaneously by the driving mechanism.

8. The nursing bed according to claim 7, wherein each of the at least two groups is configured by at least a portion of the plurality of movable strips which are arranged alternately in the longitudinal direction.

9. The nursing bed according to claim 1, wherein the at least a portion of the upper surface forming member configures a center portion in the longitudinal direction of the upper surface forming member.

10. The nursing bed according to claim 1, wherein a part of the upper surface forming member on a leg side of the care receiver in the longitudinal direction is configured by a plurality of movable rectangular pieces which are divided in both directions of the longitudinal direction and the width direction, the nursing bed being provided with an additional driving mechanism configured to move at least a portion of the plurality of movable rectangular pieces so as to raise a portion of the bed upper surface.

11. A shape change method of a nursing bed, wherein the nursing bed comprises an upper surface forming member which forms a bed upper surface on which a care receiver lies, a driving mechanism configured to move at least a portion of the upper surface forming member, and a robot arm, the driving mechanism being configured so that a rotational driving force is transmitted from a rotational driver mounted on a distal end portion of the robot arm and having a plurality of rotated drivers which are selectively and separatably connected to the rotational driver, the plurality of rotated drivers being respectively installed corresponding to mutually different moving motions in the upper surface forming member, the rotational driver driving the plurality of rotated drivers in a predetermined order, the robot arm configured to move in both left-right and up-down directions so as to allow the rotational driver to engage with any of the plurality of rotated drivers.

* * * * *